US012434163B2

(12) United States Patent
Williams

(10) Patent No.: US 12,434,163 B2
(45) Date of Patent: Oct. 7, 2025

(54) METHOD FOR FABRICATING A DOLL WITH DREADLOCK HAIR

(71) Applicant: World of EPI Company, Inc., Orlando, FL (US)

(72) Inventor: Tamra M. Williams, Orlando, FL (US)

( * ) Notice: Subject to any disclaimer, the term of this patent is extended or adjusted under 35 U.S.C. 154(b) by 193 days.

(21) Appl. No.: 18/482,813

(22) Filed: Oct. 6, 2023

(65) Prior Publication Data

US 2024/0115963 A1 Apr. 11, 2024

Related U.S. Application Data

(60) Provisional application No. 63/378,658, filed on Oct. 6, 2022.

(51) Int. Cl.
*A63H 3/44* (2006.01)
*D05C 15/02* (2006.01)

(52) U.S. Cl.
CPC ..... *A63H 3/44* (2013.01); *D05C 15/02* (2013.01)

(58) Field of Classification Search
CPC ..... A63H 3/44; D05C 15/02; A41G 3/0083; D01F 6/00
USPC ..... 446/394
See application file for complete search history.

(56) References Cited

U.S. PATENT DOCUMENTS

| | | | | |
|---|---|---|---|---|
| 2,152,085 | A * | 3/1939 | Palmer | A63H 3/44 446/394 |
| 5,180,325 | A * | 1/1993 | Eddins | A63H 3/44 446/385 |
| 6,159,598 | A * | 12/2000 | Ishimura | D01F 8/10 428/370 |
| 2006/0141900 | A1* | 6/2006 | Wesley | A63H 3/44 446/394 |
| 2007/0238389 | A1* | 10/2007 | Kobayashi | A41G 3/0083 446/394 |
| 2020/0023284 | A1* | 1/2020 | Choi | D02G 1/02 |
| 2023/0371632 | A1* | 11/2023 | Lee | D02G 1/205 |
| 2024/0026572 | A1* | 1/2024 | Nakamura | A41G 3/00 |
| 2024/0390810 | A1* | 11/2024 | Khalsa | A63H 9/00 |

* cited by examiner

*Primary Examiner* — Kimberly S Berona
(74) *Attorney, Agent, or Firm* — Intellectual Property Consulting, LLC; Adam V. Vickers

(57) ABSTRACT

A method for fabricating a toy doll with dreadlock hair is provided. The method comprises preparation of spooled dreadlock hair by twisting and matting synthetic filaments into a cylindrical dreadlock strand, sewing or rooting the dreadlock strand into a toy doll scalp, heat treating the dreadlocks, styling the dreadlocks, and then applying a hair treatment to the dreadlocks. The artisan twists the dreadlocks as they are rooted, thereby increasing their structural integrity. The doll is then heat treated to help set the dreadlocks. The artisan then styles the dreadlocks and applies a hair treatment to protect against wear and facilitate a lifelike appearance.

8 Claims, 7 Drawing Sheets

METHOD FOR FABRICATING A DOLL WITH DREADLOCK HAIR

RELATED APPLICATIONS

This application claims priority to U.S. Provisional Application No. 63/378,658, filed Oct. 6, 2022. The entire contents of the above application are hereby incorporated by reference as though fully set forth herein.

FIELD

The present invention relates in general to toy doll fabrication, and in particular to fabrication of dolls with dreadlock hair.

BACKGROUND

Toy dolls with hair have been made for centuries. The growing demand for such dolls led to the innovation of modern doll hair rooting machines, which are a type of sewing machine used to embed or "root" hair-simulating filaments or threads into the skull area of a doll head (e.g., U.S. Pat. No. 3,165,079). Mass production ensued and the toy doll industry has become an enduring staple of the children's toy market.

Toy doll design continues to evolve such that dolls are ever more realistic and durable. Doll types range from lifelike baby dolls to Marvel® and Disney® dolls designed to closely resemble famous characters. Many of these dolls incorporate developing technologies to make them more realistic, such as articulated appendages, soft, elastic skin, three-dimensional eyes, and styleable hair.

Toy designers and manufacturers are expanding the cultural and ethnic breadth of their doll product lines to represent a more diverse society, reproduce a broader collection of famous characters, and appeal to a broader consumer base. Dolls now come in myriad shapes, sizes and colors, with different purposes from lifelike baby dolls to hero action figures. Realism and lifelike accuracy is key to a majority consumer base. To increase realism, the toy doll industry is constantly innovating new material, mechanical, chemical and electrical designs. One of those innovations involves doll hair, as hair is one of the most recognizable and distinguishing human features.

Doll hair comes in various textures, colors, lengths and styles. However, none of the commercially-produced dolls have incorporated one of the most distinctive and important cultural and ethnic hairstyles—the dreadlock. A select few hobbyists have created dolls with dreadlock hair, but their methods are slow and intricate, requiring extensive handcrafting to produce a single doll. Such methods, while admirable from a craft-skill perspective, are obviously not suitable for high-volume production.

SUMMARY OF THE INVENTION

The following embodiments thereof are described and illustrated in conjunction with systems, machines and methods which are meant to be exemplary and illustrative, and not limiting in scope. In various embodiments, one or more of the above-described problems have been reduced or eliminated, while other embodiments are directed to other improvements.

The present invention is directed to a method for fabricating a toy doll with dreadlocks. The general purpose of the present invention, which will be described subsequently in greater detail, is to provide a method for applying dreadlock hair to a doll that may be styled and will maintain structural integrity through daily use. The present invention incorporates advantages of current dollmaking technology, real-life hair styling techniques, and hair treatment technologies used with humans that result in a new method which is not anticipated, rendered obvious, suggested, or even implied by any of the prior art doll fabrication methods, either alone or in any combination thereof.

In accordance with embodiments of the invention, the present invention generally comprises a spool of synthetic filament which is pre-wrapped into a cylindrical dreadlock strand. The spool is then threaded through a doll hair rooting machine which is common in the doll fabrication industry. The artisan then roots the dreadlock strand into the doll scalp and cuts the hair to create individual dreadlock hair strands. The doll is heat treated to further set the dreadlocks. The hair is styled and then a hair treatment is applied to protect against wear and facilitate a lifelike appearance.

There has thus been outlined, rather broadly, the more important features of the invention in order that the detailed description may be better understood, and in order that the present contribution to the art may be better appreciated. There are additional features of the invention that will be described and that will form the subject matter of the claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a method for fabricating a doll with dreadlocks that will overcome the shortcomings of any prior art methods.

A second object is to provide a method for efficiently and securely rooting dreadlock doll hair into a doll scalp.

Another object is to provide a method for setting the dreadlocks to improve durability and longevity after they have been rooted into the doll scalp.

An additional object is to provide a method for treating the dreadlocks after they have been set to further improve dreadlock durability and appearance.

A further object is to provide a method for fabricating a doll with dreadlocks that may be used in high-volume production of toy dolls for general consumer retail purposes.

Other objects and advantages of the present invention will become obvious to the reader, and it is intended that these objects and advantages are within the scope of the present invention.

To the accomplishment of the above and related objects, the present invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE INVENTION

For a further understanding of the nature and function of the embodiments, reference should be made to the following detailed description. It will be readily appreciated that the embodiments are well adapted to carry out and obtain the ends and features mentioned as well as those inherent herein. It is to be understood, however, that the present invention is embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

A method of fabricating a doll with dreadlock hair is provided in accordance with the embodiments of the invention. In an embodiment, the method incorporates synthetic filaments twisted into a dreadlock-style hair strand, a doll hair rooting machine, a doll scalp, a heating mechanism, and a chemical hair treatment.

Figure 1:
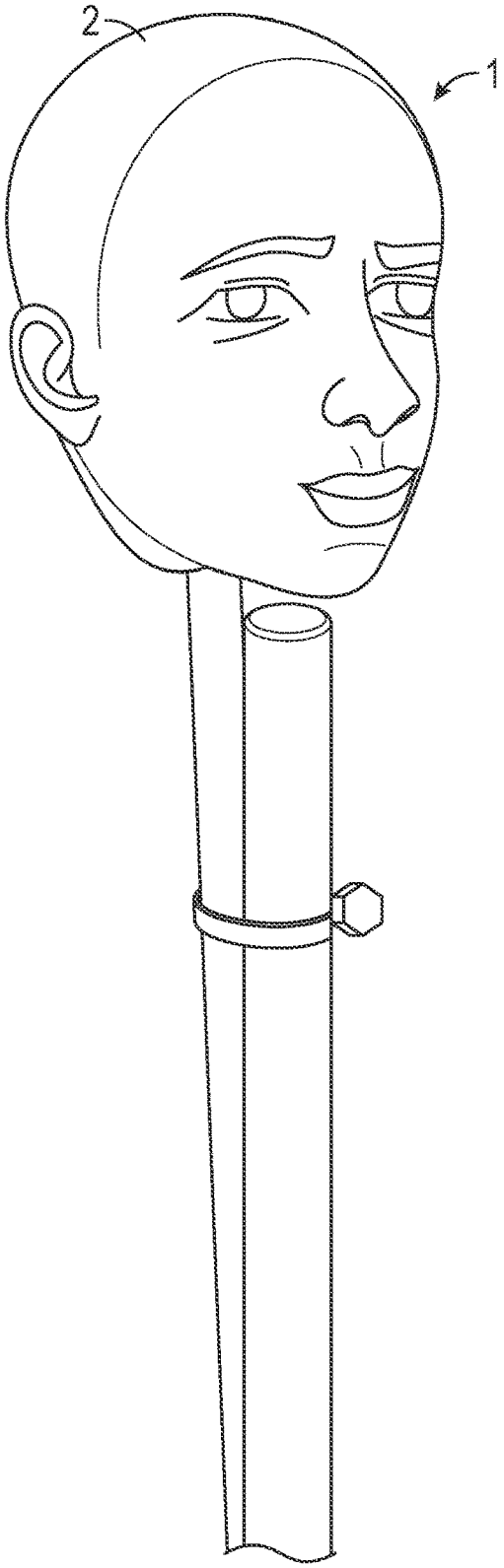
FIG. 1 is a perspective view of a doll head with a bald synthetic scalp before hair is sewn or rooted into the scalp.

FIG. 1 shows an embodiment of doll head 1 with scalp 2 attached. Scalp 2 typically comprises a synthetic, elastic material such as plastic polymer or silicone. However, any elastic material will be suitable for scalp 2 if it is capable of maintaining its structural integrity with hundreds of closely-spaced punctures throughout.

Figure 2:
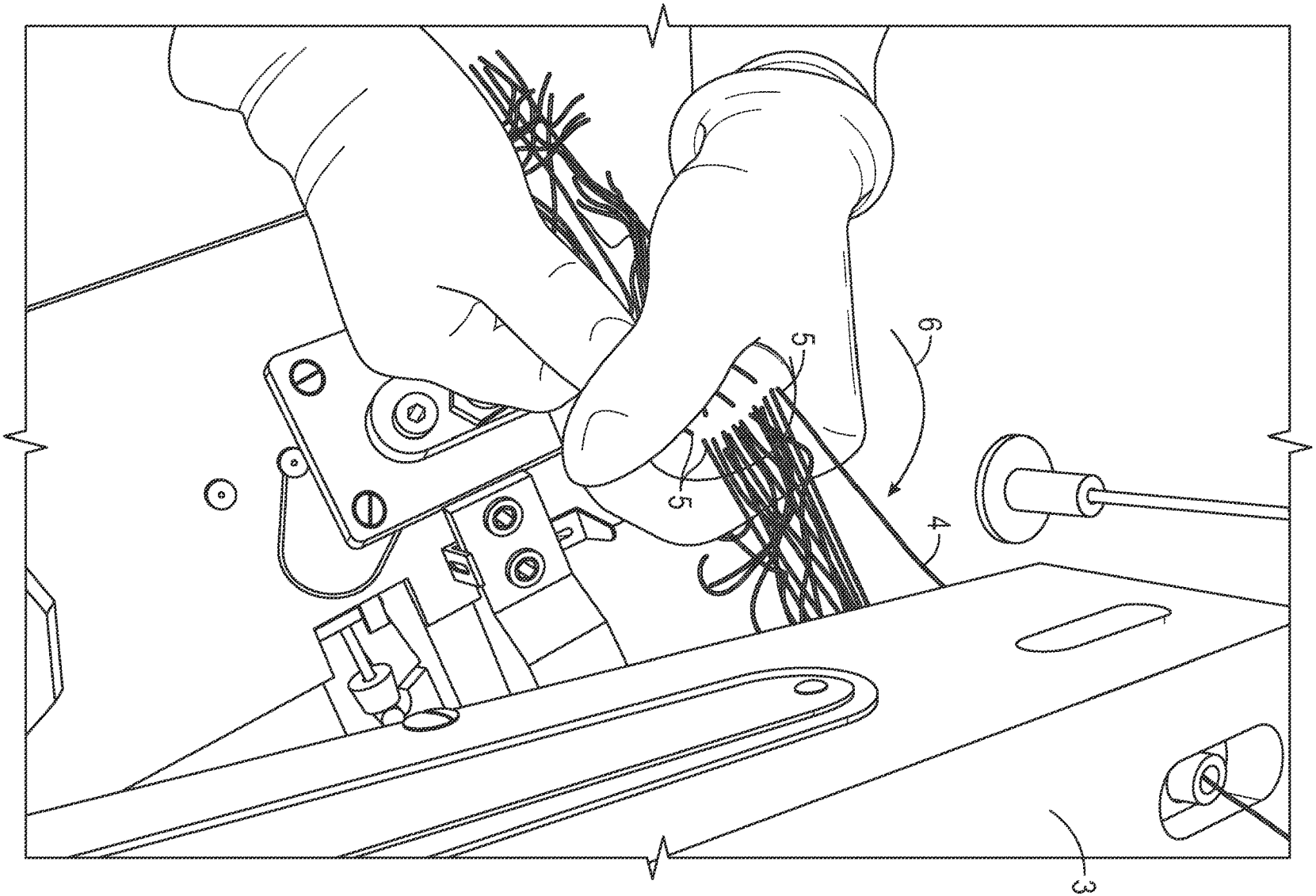
FIG. 2 is an overhead view of an artisan sewing or rooting doll hair into the doll scalp.

To begin the dreadlock hair rooting process, the dollmaker artisan loads doll scalp 2 onto doll hair rooting machine 3 depicted in FIG. 2. Doll hair rooting machine 3 is generally well-known in the art and may be any such typical doll hair rooting machine. Before the rooting process begins, the artisan twists or wraps two or more synthetic hair filaments to create pre-wrapped dreadlock hair strand 4 shown in FIG. 2. The synthetic hair filaments are well-known in the art and typically comprise a nylon or similar material. Dreadlock hair strand 4 is typically twisted to 1.8 to 2.0 millimeters thick to create a styleable dreadlock with a realistic appearance that can also be rooted using doll hair rooting machine 3. However, dreadlock hair strand 4 may be twisted to a thinner or thicker dreadlock hair strand 4 at the artisan's discretion.

As shown in FIG. 2, dreadlock hair strand 4 is loaded into doll hair rooting machine 3. The artisan activates doll hair rooting machine 3 and begins rooting dreadlock hair strand 4 into scalp 2 as the needle of doll hair rooting machine 3 repeatedly pierces scalp 2 at follicles 5. The artisan moves scalp 2 back and forth while doll hair rooting machine 3 continues to root dreadlock hair strand 4 at newly-created follicles 5 throughout scalp 2. As the artisan moves scalp 2 back and forth, the artisan also twists scalp two as shown by twisting motion 6. Twisting motion 6 may be clockwise or counterclockwise, whichever direction is consistent with the way dreadlock hair strand 4 is twisted to facilitate tightening of dreadlock hair strand 4. The artisan continues with the hair rooting process depicted in FIG. 2 until the artisan is satisfied that scalp 2 is sufficiently populated with rooted strands of dreadlock hair strand 4. The artisan then removes scalp 2 from doll hair rooting machine 3.

Figure 3A:
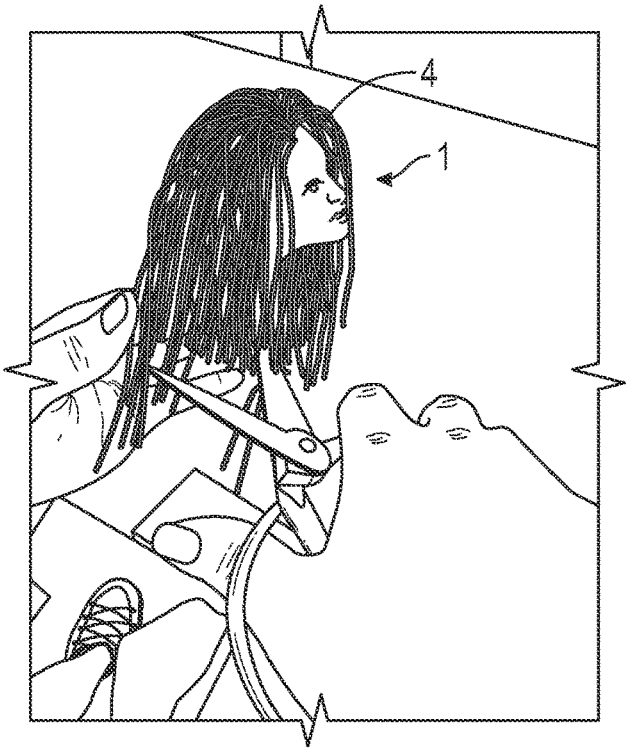
FIG. 3A is a side view of an artisan cutting the dreadlocks after they have been sewn or rooted into the doll scalp.
Figure 3B:
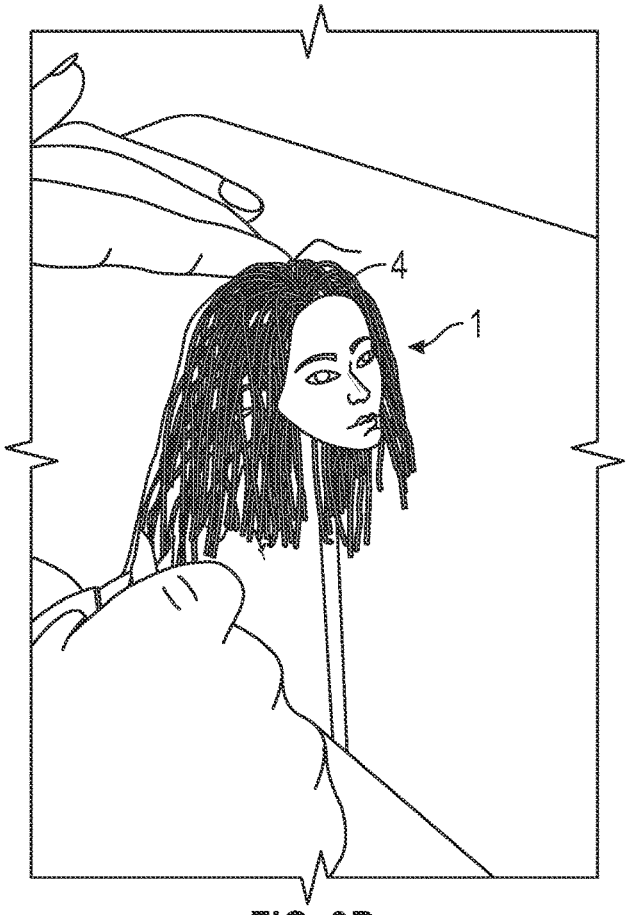
FIG. 3B is a perspective view of an artisan cutting the dreadlocks after they have been sewn or rooted into the doll scalp.

FIG. 3A and FIG. 3B show initial styling of dreadlock hair strands 4. The artisan may mount doll head 1 onto a stand or other device to help hold doll head 1 in place. The artisan may then comb, brush or otherwise shape dreadlock hair strands 4 to a favorable style. The artisan may also cut or trim dreadlock hair strands 4 to the desirable length.

Figure 4:
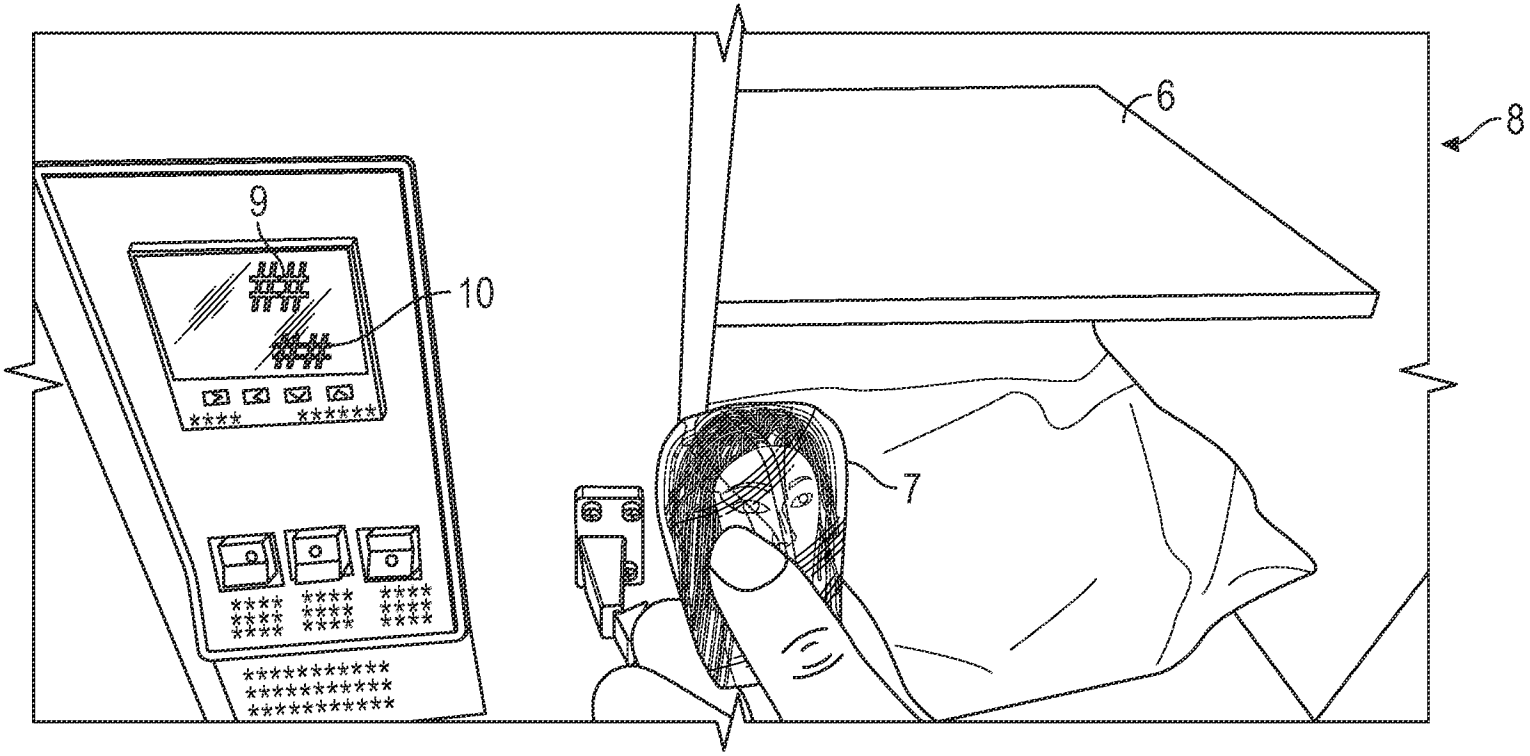
FIG. 4 is a front view of an artisan putting a doll head with dreadlocks into an oven for heat treatment of the dreadlocks.

FIG. 4 depicts doll head 1 being placed into oven 6 after dreadlock hair strands 4 have been rooted. Before doll head 1 is placed into oven 6, the artisan wraps doll head 1 with hair constraint 7. In one embodiment, hair constraint 7 comprises a thermoplastic polymer such as a polyethylene sheet. However, any material which is operable to hold dreadlock hair strands 4 down and withstand heat treatment without melting into or otherwise bonding with dreadlock hair strands 4 or doll head 1 during baking process 8 discussed further below. In one embodiment, hair constraint 7 may be shaped like a bag, open on one end and fully covering doll head 1. In another embodiment, hair constraint 7 may comprise a band which wraps around doll head 1, leaving follicles 5 open to the environment.

Baking process 8 begins after doll head 1 is placed into oven 6. In one embodiment, baking process 8 comprises the process of baking doll head 1 in oven 6 at temperature 9 for a predetermined time 10 to set dreadlock hair strands 4. The reason for setting dreadlock hair strands 4 is to further strengthen their structural integrity and to help prevent fraying or unraveling, thereby improving durability and resistance to typical wear and tear. In one embodiment, temperature 9 may be approximately 150 degrees Fahrenheit to approximately 200 degrees Fahrenheit, and time 10 may be approximately 15 minutes to approximately 20 minutes. The artisan may adjust the time and temperature of baking process 8 to obtain a desirable look and feel of dreadlock hair strands 4. For example, a longer baking time at a higher temperature may yield a harder and more rigid set of dreadlock hair strands 4. On the other hand, a shorter baking time at a lower temperature may yield a softer and more pliable set of dreadlock hair strands 4.

One benefit of the foregoing embodiment of baking process 8 is it may be used to heat treat many doll heads to achieve uniformity during mass production. Another benefit is it frees the artisan to complete other tasks while doll head 1 is baking, thereby increasing overall manufacturing process efficiency. Yet another benefit is the results should yield predictable and repeatable results for the same times, temperatures and characteristics of dreadlock hair strands 4.

In another embodiment, baking process 8 comprises the process of applying heat to dreadlock hair strands 4 using a hair dryer or a heat gun. In such embodiment, the artisan suspends doll head 1 and applies heat using a hair dryer or a heat gun for an undetermined amount of time until the artisan is satisfied that dreadlock hair strands 4 are set to the artisan's desire. One benefit of such embodiment of baking process 8 is it allows the artisan to customize dreadlock hair strands 4 for each doll head 1. This embodiment gives the artisan the freedom to set different portions of dreadlock hair strands 4 at different levels of hardness and rigidity determined by the artisan during baking process 8.

Figure 5:
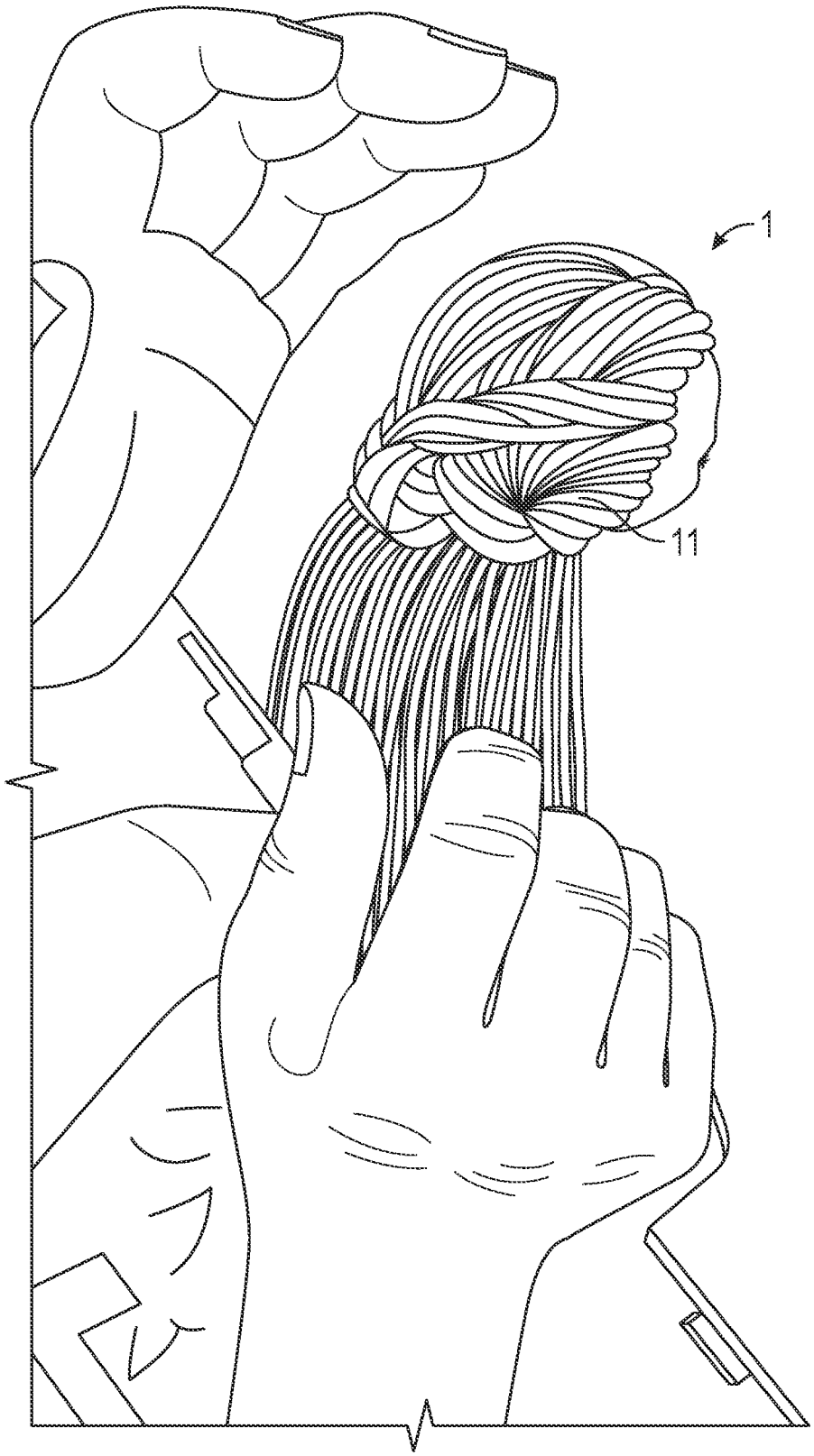
FIG. 5 is a perspective view of an artisan styling dreadlocks after they have been heat treated.

Doll head 1 is removed from oven 6 or any alternative heat source after baking process 8 is complete to allow dreadlock hair strands 4 to cool. The artisan may begin styling dreadlock hair strands 4 when they are cool to the touch. One embodiment of styled dreadlocks 11 is shown in FIG. 5.

Figure 6:
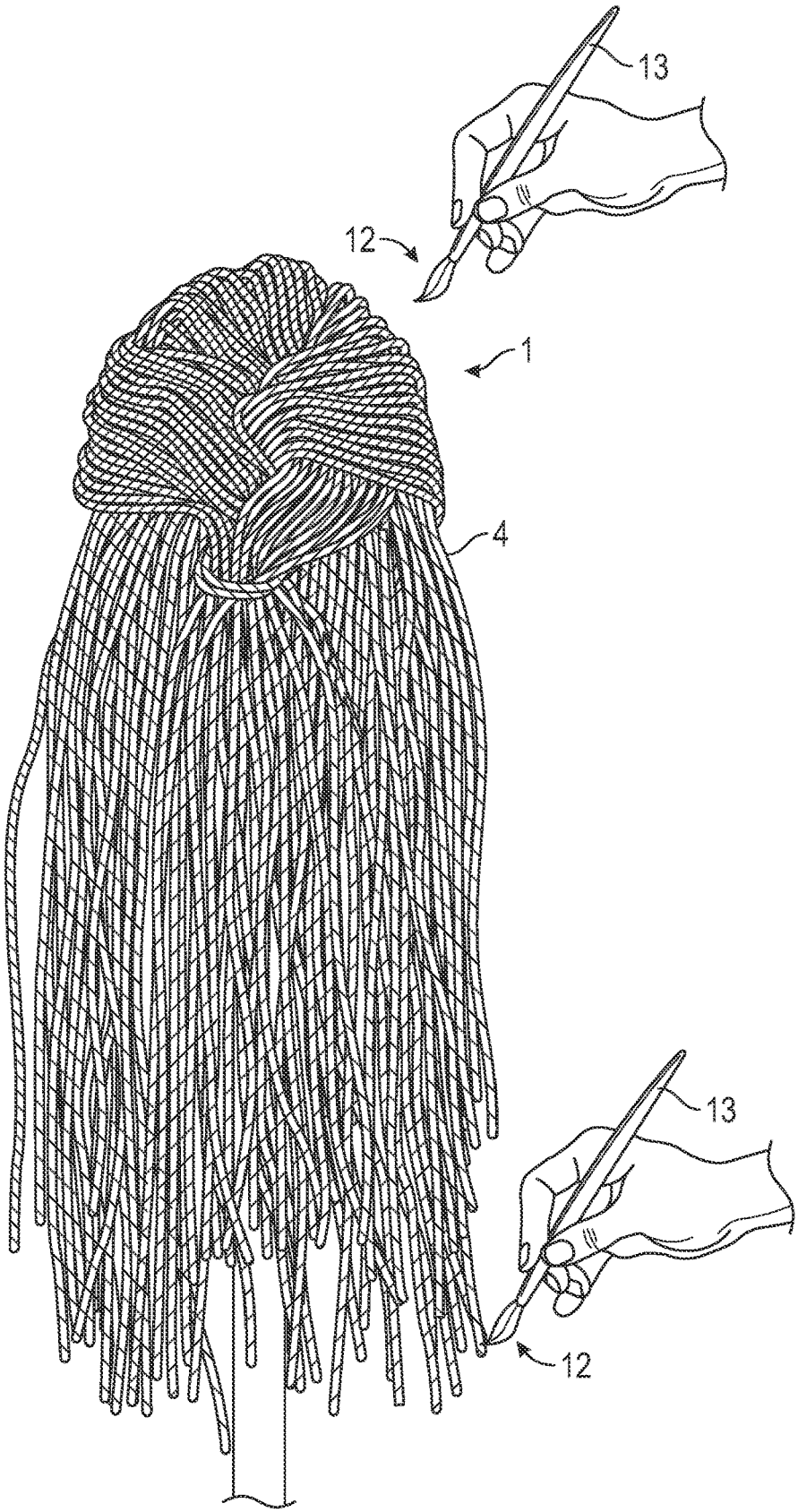
FIG. 6 is a rear view of an artisan applying a hair treatment chemical to dreadlocks after they have been rooted and styled.
Figure 7:
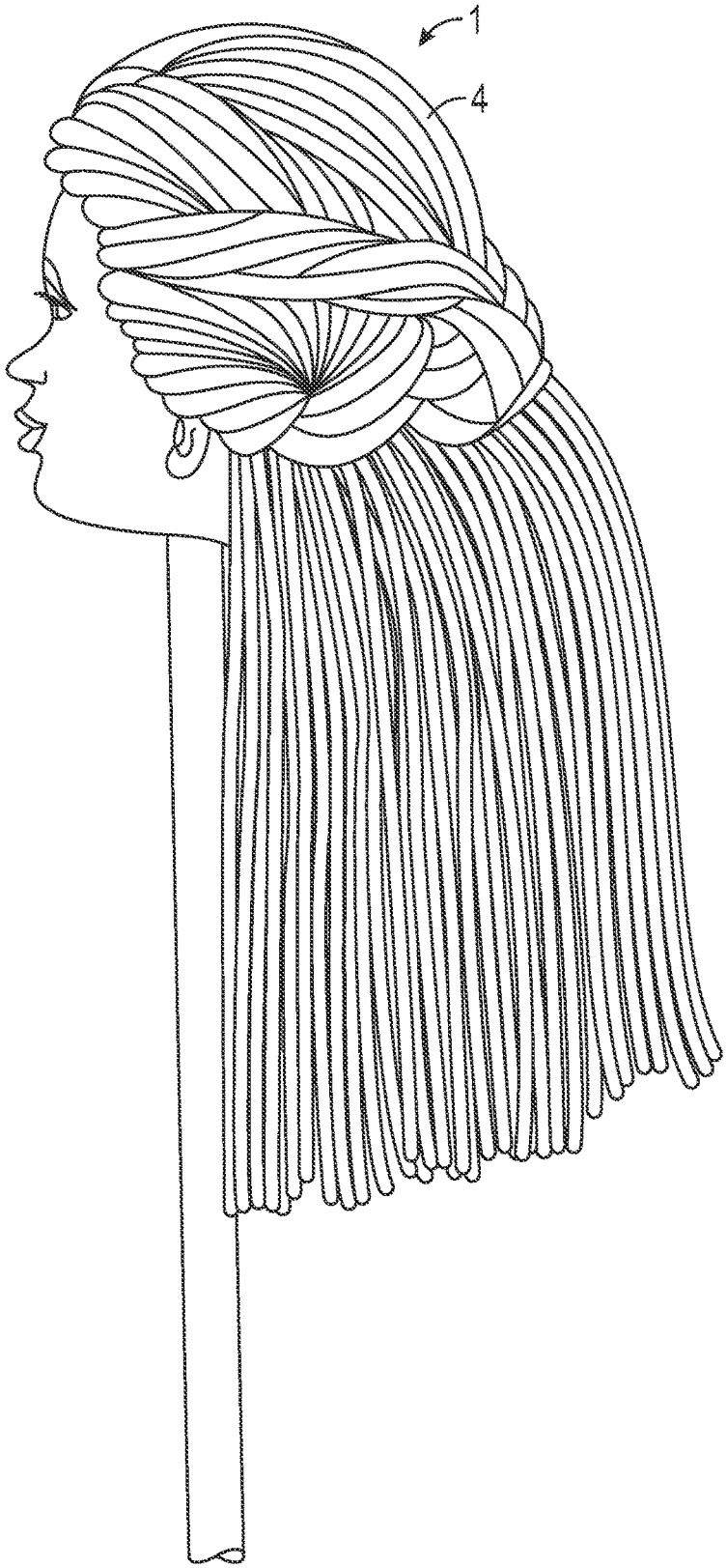
FIG. 7 is a side view of a finished doll head with dreadlocks.

FIG. 6 depicts hair treatment application 12, which comprises application of a hair treatment to dreadlock hair strands 4 after they are cool to the touch. Such hair treatments strengthen dreadlock hair strands 4, seal their exterior surface, improve durability, prevent fraying and unraveling, and add a degree of sheen or matte finish to facilitate a lifelike appearance. In one embodiment, hair treatment application 12 comprises application of a hair treatment using brush 13. Particular reference is made to application of the hair treatment to the cut ends of dreadlock hair strands 4, where they are most susceptible to fraying or unraveling.

The hair treatment may comprise hair gel or hair glue, both of which are known in the hair industry. In one embodiment, the hair treatment comprises a polyvinylpyrrolidone (PVP) water-soluble synthetic hair gel is applied to dreadlock hair strands 4. In another embodiment, the hair treatment comprises a water resistant, beeswax-based hair glue. In a further embodiment, the hair treatment comprises a latex-based hair glue. In an additional embodiment, the hair treatment comprises an acrylic-based hair glue.

For the purposes of promoting and understanding of the principles of the invention, reference has been made to the embodiments illustrated in the drawings, and specific language has been used to describe these embodiments. However, it will be apparent to those skilled in the art that various modifications and variations are possible while preserving the spirit and scope of the invention. Accordingly, the specific language herein intends no limitation of the scope of the invention, and the invention should be construed to encompass all embodiments that would normally occur to one of ordinary skill in the art.

I claim:

1. A method of fabricating a doll with dreadlock hair, said method comprising the steps of:

twisting at least one hair filament to create a hair lock, sewing multiple hair locks into a doll scalp using a doll hair rooting machine, wherein each hair lock comprises a root end and a cut end, styling said hair locks into a predetermined hairstyle; and applying a hair constraint around said doll scalp and hair locks, and heating said hair locks within a predetermined temperature range for a predetermined amount of time.

2. The method of claim 1, wherein each said hair lock comprises more than one filament of synthetic polymer twisted together to form an elongated cylindrical shape.

3. The method of claim 1, wherein said hair locks are heated at a temperature of 150 degrees Fahrenheit up to 200 degrees Fahrenheit.

4. The method of claim 1, wherein said hair locks are heated for at least 15 minutes and no longer than 20 minutes.

5. The method of claim 1, wherein said hair locks are heated in an oven.

6. The method of claim 1, wherein said hair constraint comprises a polyethylene polymer.

7. The method of claim 1, further comprising the steps of allowing said hair locks to cool after said heating, and applying hair treatment to said hair locks from said root end to said cut end after said hair locks are cooled.

8. The method of claim 7, wherein said hair treatment is applied to said cut end of said hair locks after said hair locks are styled.

* * * * *